US005257829A

United States Patent [19]

Weeks

[11] Patent Number: 5,257,829

[45] Date of Patent: Nov. 2, 1993

[54] SAWHORSE

[75] Inventor: Fred Weeks, Richmond, Mich.

[73] Assignee: Proto-Form Engineering, Richmond, Mich.

[21] Appl. No.: 881,847

[22] Filed: May 12, 1992

[51] Int. Cl.[5] ..... E04G 1/00

[52] U.S. Cl. ..... 182/181; 182/224; 182/151

[58] Field of Search ..... 182/181, 182, 183, 184, 182/185, 186, 226, 224, 151; 269/901

[56] References Cited

U.S. PATENT DOCUMENTS

| | | | |
|---|---|---|---|
| 304,207 | 8/1884 | Langlais | 182/181 |
| 934,736 | 9/1909 | Koch | 182/181 X |
| 1,662,700 | 3/1928 | Dyer | 182/226 |
| 2,373,485 | 4/1945 | Long | 182/181 |
| 2,816,805 | 12/1957 | Vaughn | 182/181 |
| 3,008,535 | 11/1961 | De Vries | 182/181 |
| 3,167,290 | 1/1965 | Beckwell | 182/181 X |
| 3,266,595 | 8/1966 | Bormann | 182/181 |
| 3,605,945 | 9/1971 | Knuth | 182/151 |
| 4,030,565 | 6/1977 | Chaput | 182/151 |
| 5,113,920 | 5/1992 | Sedeniussen | 182/181 X |

FOREIGN PATENT DOCUMENTS

| | | | |
|---|---|---|---|
| 561298 | 4/1957 | Italy | 182/186 |

*Primary Examiner*—Blair M. Johnson
*Attorney, Agent, or Firm*—Howard & Howard

[57] ABSTRACT

An improved collapsible sawhorse 100 is constructed as a traverse horizontal cross member 102 supported by vertical members or lateral trusses 104, 106. Brace members 120, 122 are mounted at one end to the inside surface of each leg bracket with a brace mounting assembly 124. The other end of each brace member is attached to the cross member with brace member locator and handle assembly 126. A nut and bolt assembly 134 on each vertical member is tightened to hold the cross member securely. An alternate embodiment of the present invention uses at least one adapter leg 200.

15 Claims, 2 Drawing Sheets

SAWHORSE

FIELD OF THE INVENTION

The present invention relates to sawhorses and more particularly to a relatively inexpensive sawhorse which can be disassembled and folded compactly for storage and travel, but which is still strong and stable.

BACKGROUND ART

Several attempts have been made to develop a relatively inexpensive easily collapsible sawhorse. One such attempt is disclosed in U.S. Pat. No. 4,640,386 entitled *Folding Utility Horse.* This sawhorse is made of metal which appears to be necessary due to the manner in which the sawhorse obtains what stability that it has. As illustrated in FIGS. 4 and 5 of the patent, the sawhorse is collapsed and supported through a bracket assembly which is fairly complex and would be rather expensive to reproduce. The only support that this sawhorse has in the longitudinal direction is from bolt 60 and stop member 64. When assembled, each sawhorse leg engages a stop member 64 and a bolt 60 engages a slot 62 in each leg to secure the leg in place. As should be appreciated, longitudinal movement of the sawhorse will tend to enlarge the opening 62 and reduce its ability to stabilize the sawhorse. This is particularly true when either end of the sawhorse is urged in a direction opposite to the respective stop 64. Another difficulty with this sawhorse is the need to tighten and properly align bolt 60 in slot 62 which is cumbersome and time consuming.

Other examples of collapsible sawhorses are disclosed in U.S. Pat. No. 3,529,697 entitled Collapsible Horse and U.S. Pat. No. 2,983,329 entitled Demountable Sawhorse. Each of these sawhorses suffer from the same disadvantage in that they provide limited support in the longitudinal direction and they must be constructed of fairly heavy, sturdy materials to provide support.

The '697 patent uses an end bracket that is received within a longitudinal slot in the end of the cross member and bolted laterally through the cross member. The disclosed material is wood, and it appears that wood or another strong material such as metal would have to be used because in use the lateral bolt will wear on the walls of the hole in the cross beam weakening the stability of the sawhorse in the lateral and longitudinal directions. It appears that wear will occur no matter what material is used, but sturdier material would withstand wear for a longer period of time. Materials such as plastic or aluminum would not be acceptable in this type of arrangement. Regardless of the material used, the sawhorse is still relatively weak in the longitudinal direction because the only support that it receives is from the V-shaped slot 32 of extension 30 resting on shank 36 and the compressive force that can be obtained by tightening the legs about extension 30.

The sawhorse disclosed in the '329 patent has the same disadvantages that are found in the '697 patent except( they are even more pronounced. In the '329 patent the legs are only supported by the compressive force obtained by tightening the hand nuts 29 against the legs 11, there is nothing to provide stability in the longitudinal direction. Further, the sawhorse has the disadvantage of being somewhat self destructive in that every time the sawhorse is disassembled, the teeth 27 on the leg brackets must penetrate the cross member to provide stability. After repeated penetrations, the cross member will weaken and the stability will be decreased. Other examples of this type of sawhorse assembly can be found in U.S. Pat. Nos. 2,973,053; 2,112,778 and 737,000. Variations of this type of sawhorse can be found in U.S. Pat. Nos. 2,941, 618 and 2,343,557.

None of these sawhorses provide a light weight sawhorse which can be made of lightweight material such as for example plastic oraluminum, which is easily dissassembled to fold compactly. The present invention is directed toward eliminating the above deficiencies.

SUMMARY OF THE INVENTION

The present invention is a sawhorse which can be easily disassembled and folded compactly for storage and travel. Briefly, the sawhorse of the present invention uses a convenient tightening system, a sliding brace guide, a cooperating fastening means which provides increased strength and stability, and a latch system for compact storage.

According to one aspect of the present invention, the sawhorse includes a rigid cross member extending horizontally on the assembled sawhorse, and left and right trusses or vertical members supporting opposite ends of the cross member. The top of each vertical member or truss has a threaded guide shaft fixed securely in the back leg which extends through to the front leg with a wrench handle and nut near the front of the shaft. Each front and back leg member is also truncated at its top substantially parallel to the front and back faces of the cross member to form clamp jaws to accept the cross member. Turning the wrench handle advances the front and back parallel faces or clamp jaws of the legs toward each other which increases the compressive force on the cross member connecting the legs to the cross member. For additional strength and for ease in aligning the vertical members the preferred embodiment of the cross member has vertical slots for receipt of the legs.

Longitudinal stability of the sawhorse is achieved from brace members which interconnect the vertical members to the cross member. Because of the brace members, the threaded guide shaft and nut are used to attach the legs to the cross member and mainly provide lateral support. Therefore, the nut does not need to be tightened excessively and penetrating members are not needed to puncture the cross member for stability as in prior art devices.

According to another aspect of the present invention a sawhorse is provided in which at least one of the vertical members is adapted for use in close spaces. In this aspect of the invention, at least one of the vertical members is a single leg that allows one end of the sawhorse to be received within a tight place.

According to another aspect of the present invention, a sawhorse is disclosed which includes a brace mounting assembly adapted to allow the brace member to disengage and slide along a guide enabling the user to fold the brace compactly against the vertical member for storage.

According to another aspect of the present invention, a method is disclosed for disassembling and compactly folding the sawhorse of the present invention. The method includes the steps of detaching the left and right brace members from the cross member, removing the cross member from the vertical members, repositioning the brace members substantially parallel to and flat against the vertical members, positioning the cross member between the vertical members to align a cooperating fastening means, then securing the one vertical member to the other using the fastening means.

It is therefore an object of the present invention to provide a sawhorse that is easily disassembled and folds compactly for storage and transport through the use of a wrench handle nut and bolt assembly, a sliding brace guide and a cooperating fastening means.

Another object of the present invention is to provide a sawhorse with increased strength and stability through the use of an interlocking leg brace arrangement.

A further object of the present invention is to provide an alternate embodiment of the sawhorse adapted for use in close spaces that is stable due to the use of at least one straight leg in conjunction with an interlocking leg brace arrangement and a truss member.

Other objects, features and advantages will become clear or will be made apparent during the course of the following description of a preferred embodiment of the present invention.

DETAILED DESCRIPTION OF THE PREFERRED EMBODIMENTS

Figure 1:
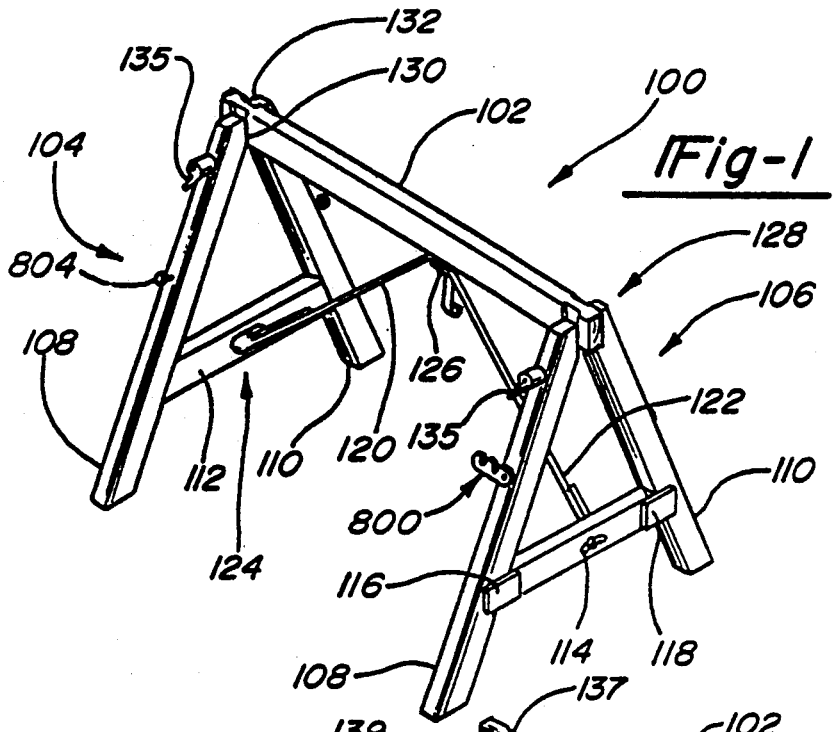
FIG. 1 is a perspective view of the Improved sawhorse of the present invention fully assembled.

Referring now to the drawings wherein like reference numerals are used to reference identical components in various views, FIG. 1 depicts the fully assembled sawhorse 100 of the present invention including cross member 102 supported by left lateral truss or vertical member 104 and right lateral truss or vertical member 106. Each lateral truss 104, 106 includes front leg member 108 extending angularly apart from a back leg member 110. Front leg member 108 and back leg member 110 are rigidly connected by left leg bracket 112 and right leg bracket 114 respectively. In the preferred embodiment each leg bracket 112, 114 is secured to and between front leg member 108 and back leg member 110 by fastener plates 116 and 118. It should be appreciated by one of ordinary skill in this art that other types of mounting methods could be used to connect the brackets 112 and 114.

Figure 2:
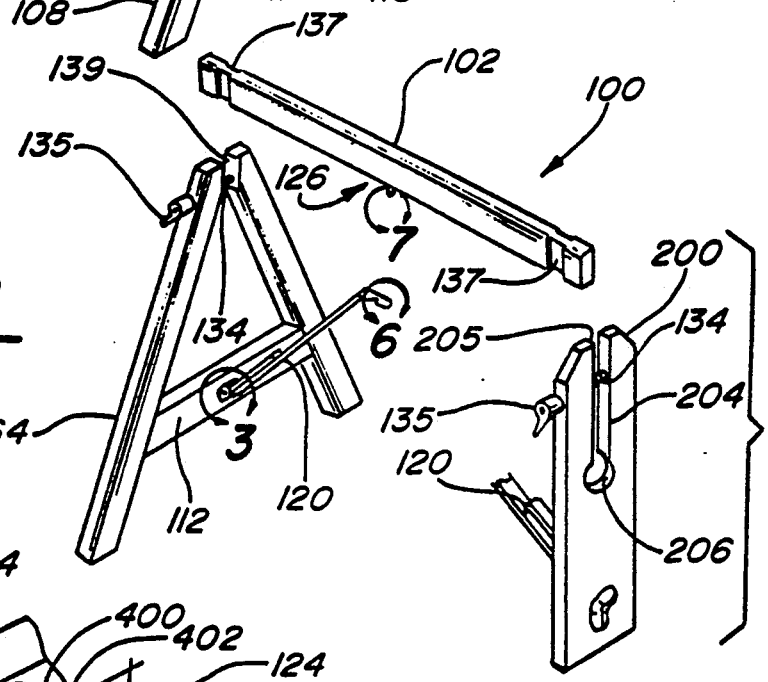
FIG. 2 is a perspective view of an alternative embodiment, showing a close space adapter leg.

As illustrated in FIGS. 1 and 2, the legs 108 and 110 of the left and right trusses 104 and 106 are truncated at their top substantially parallel to the vertical sides of the cross member 102 to form clamp like jaws shown at 139 for clamping to the cross member. A wrench handle and nut assembly 135 are connected to a bolt 134 which extends through each of the opposed legs 108 and 110. By tightening nut assembly 135 the upper portion of the opposed legs 108 and 110 are compressed against the sides of the cross member 102 to secure the legs to the cross member 102. The cross member of the preferred embodiment includes grooves 137 on the front and back of each end. These grooves facilitate alignment and mounting of the legs 108 and 110 to the cross member 102 and to a small degree assist in the longitudinal stability of the sawhorse.

It should be appreciated by those of ordinary skill in the art that assembly 135 and bolt 134 are basically attaching the trusses 104 and 106 to the cross member 102. The longitudinal forces that may be applied to the sawhorse are resisted by the trusses 104 and 106 in conjunction with brace members 120 and 122. Therefore, the trusses 104 and 106 can be made of lightweight material such as plastic which is preferred or aluminum because there is no stress on bolt 134 and the hole which receives it in each member 104 and 106. Of course, other material, such as wood or metal can be used if desired and the sawhorse will still benefit from the teachings of this invention.

Right and left brace members 120 and 122 are mounted on the inside surface of the left and right leg brackets 112 and 114 respectively by brace mounting assemblies 124. The brace members 120 and 122 are adapted to be secured to cross member 102 by a locking assembly 126. In operation, the brace members 120 and 122 and the mounting assemblies 124 can be pivoted from a storage position to a use position so that the brace members 120, 122 can be connected to the cross member 102 by a locking assembly 126 in the use position and compactly stored in the storage position. The mounting assemblies 124 and the locking assembly 126 will be described in greater detail below.

FIG. 2 depicts the adapter leg 200 of the present invention which permits the sawhorse to be used in close quarters. Adapter leg 200 provides support for cross member 102. Adapter leg 200 includes a vise-like connecting means 204. The connecting means 204 has jaws 205 and a relief 206 that facilitates the compression of jaws 205 against cross member 102. As discussed above, a wrench handle and nut assembly 135 and bolt 134 are used to compress the jaws 205 against the cross member 102. The interlocking leg brace arrangement of the present invention provides longitudinal stability. It should be understood that an adapter leg 200 could be used on both sides of the sawhorse, but for stability, the use of only one adapter leg is preferred.

Figure 3:
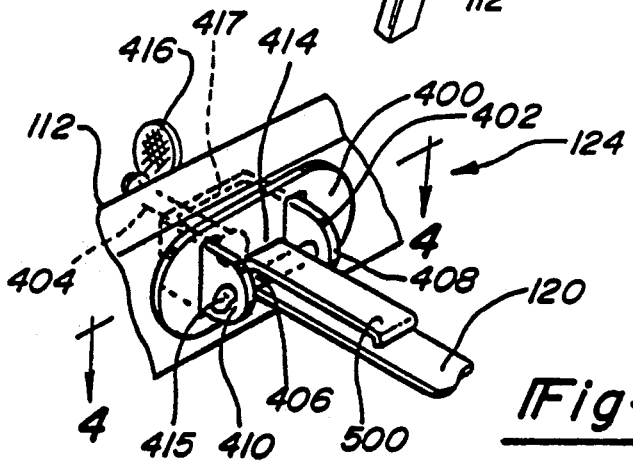
FIG. 3 is a perspective view of the brace member mounting assembly as shown in circle 3 of FIG. 2.
Figure 4:
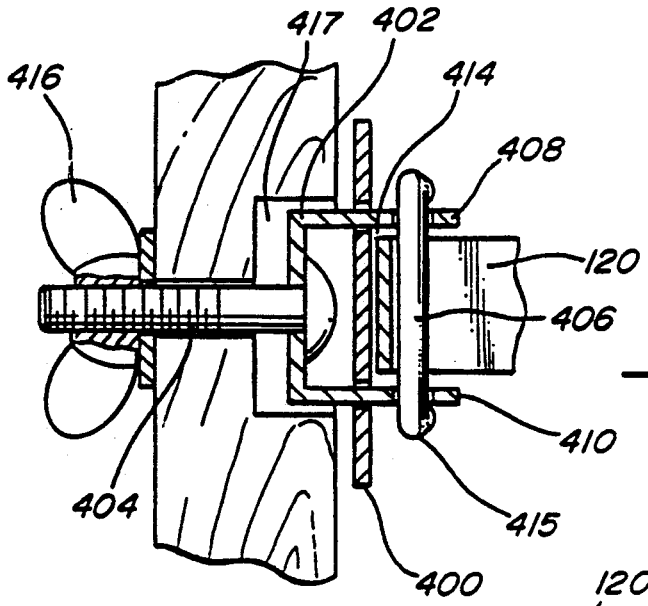
FIG. 4 is a cross-sectional view of the brace mounting assembly viewed in the direction of arrows 4—4 in FIG. 3.

FIG. 3 depicts brace member mounting assembly 124 mounted on left leg bracket 112 and left brace member 120. Brace member mounting assembly 124 as depicted in FIG. 4 includes face plate 400, key bracket 402, fastener 404, and key 406. Fastener 404, preferably a standard machine screw including a wing nut 416, retains key bracket 402 to the leg bracket 112, 114. When assembled, the fastener 404 is inserted through the key bracket 402 and then through the leg bracket 112. Leg bracket 112 is counterbored at 417 for receipt of the key bracket 402. Face plate 400 has two slots that receive first and second ears 408 and 410 of key bracket 402. These slots can be seen in FIG. 3. Each of the ears 408 and 410 has a slot in it for receipt of the key 406. To attach the brace 120 and the face plate to the mounting assembly 124, key 406 is slipped into a slot in one of the ears 408 or 410, through the brace member 120 at the sliding brace guide 500 and then through the slot in the other ear 408 or 410. The key 406 has tabs 415 at each end which keep the key from falling out of the slots in ears 408 and 410. The tabs 415 are dimensioned so that they can initially fit into the slots when the key is closely adjacent to the face plate 400 and the head of fastener 404. When key 406 is moved toward the ends of ears 408 and 410 by tightening wing nut 416 upon the fastener 404, the tabs 415 prevent the key 406 from being removed from ears 408 and 410.

As illustrated in FIG. 4, there is space between the face plate 400 and the key 406 so that brace member 120 can slide with respect to the mounting assembly 124. As stated above, leg bracket 112 is counterbored for receipt of the key bracket 402. The bore has a diameter which is greater than the width of key bracket 402 so that key bracket 402 can rotate with respect to bracket 112 when the wing nut on fastener 404 is loosened. This permits brace member 120 to be moved between storage and use positions. The counterbore has a depth that is great enough to receive the key bracket 402 sufficiently to permit face plate 400 to be forced against brace member 120 to lock brace member 120 between plate 400 and key 406 when the wing nut 416 is tightened against the outer side of leg bracket 112. The ability to lock brace member 120 in this way is important to provide stability to the sawhorse when in use and to lock the brace member 120 in the storage position when the sawhorse is stored.

Figure 5:
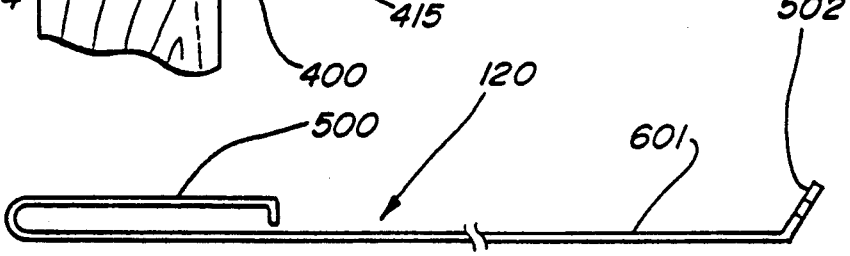
FIG. 5 is a side view of the left brace member viewed in the direction of arrow 5 in FIG. 2.
Figure 6:
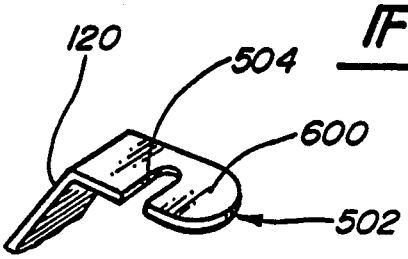
FIG. 6 is the perspective view of the engagement surface and retaining slot of the left brace member as shown in circle 6 of FIG. 2.

FIGS. 5 and 6 depict left brace member 120 including sliding brace guide 500 and brace retaining end 502. Cross member engagement flange 600 on left brace member 120 is shown in FIG. 6. Left 120 and right 122 brace members are mounted respectively to left 112 and right 114 leg brackets each with brace mounting assembly 124. Sliding brace guide 500 mounts brace members 120, 122 to leg brackets 112, 114 respectively using key 406. Key 406 is slipped into retaining slots in first 408 and second 410 ears of left key bracket 402 thereby trapping left brace member 120 within clearance 414.

As illustrated in FIGS. 5 and 6, the engagement flange 600 on each of the brace members 120, 122 is angled with respect to the body 601 of the brace member. Flange 600 is angled so that it is in surface to surface contact with the underside of cross member 102 when fastened to cross member 102. The orientation of the brace members 120 and 122 when assembled is illustrated in FIGS. 1 and 2.

Figure 8:
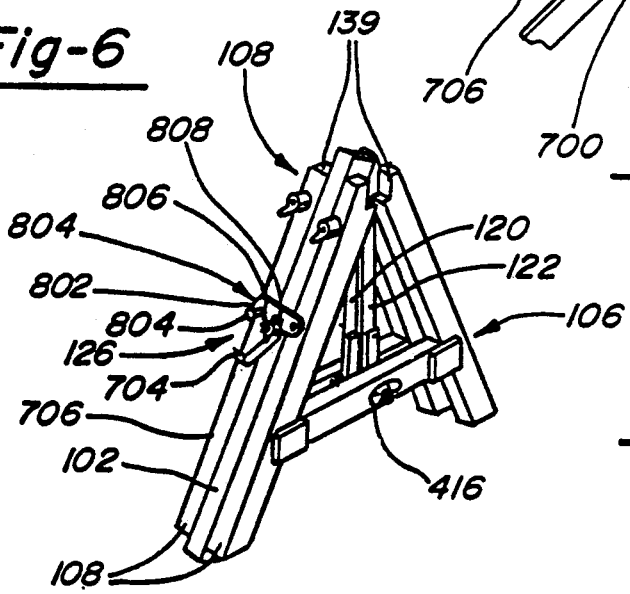
FIG. 8 is a perspective view of the present invention disassembled and arranged to fold compactly.

For compactness, the orientation of brace members 120 and 122 is changed when the sawhorse is stored. Mounting assembly 124 is adapted to rotate with respect to its respective leg bracket 112, 114. Rotation is achieved through fastener 404 which is adapted to rotate within the respective opening in leg brackets 112, 114. The storage position of brace 122 is shown in FIG. 8. Flange 600 is received between legs 108 and 110 of each vertical member 104 and 106 for protection and compactness.

Figure 7:
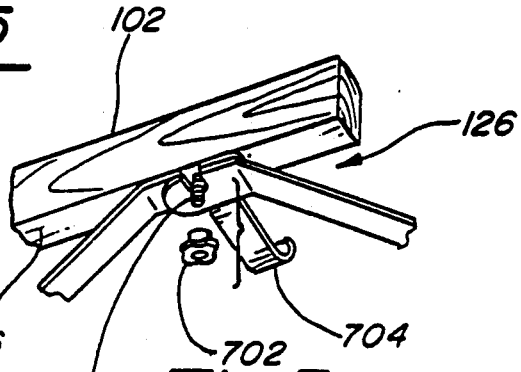
FIG. 7 is a front view of brace member fastening means mounted on the cross member viewed in the direction of arrow 7 in FIG. 2.

FIG. 7 depicts brace member fastening assembly 126 mounted to the underside of cross member 102. The fastening assembly 126 includes threaded member 700, nut 702, and a handle arm 704. Brace retaining slots 504 on both left 120 and right 122 brace members are slipped onto threaded member 700 thereby aligning flange 600 on each brace member 120 and 122 parallel against under-surface 706 of cross member 102. Threaded nut 702 is then advanced toward the under-surface 706 along threaded member 700 until brace members 120 and 122 are secure between nut 702 and under-surface 706. Once the braces 120 are connected between vertical members 104 and 106, and cross member 102, the sawhorse is stable in the longitudinal direction as well as the lateral direction.

FIG. 8 depicts the present invention disassembled and arranged to fold compactly. Left and right brace members 120 and 122 have each been dis-engaged from fastening assembly 126. Cross member 102 has been removed from jaws 139 then rotated to align under-surface 706 with the front of left and right front leg members 108. Left 120 and right 122 brace members have each been pivoted then slid downward according to the travel provided by sliding brace guide 500. Left lateral vertical member 104 and right lateral vertical member 106 sandwich cross member 102 between them in a compact configuration.

Latch assembly 800 is used to secure the compact configuration. Latch assembly 800 includes latch 802 mounted on right vertical member 106, latch post 804 mounted on left vertical member 104, and latch post slot 806 and handle post slot 808. Latch 802 is rotated to engage latch post 804 in latch post slot 806. Clearance for handle post 700 is provided by handle post slot 808. Nut 702 is then advanced along threaded member 700 to retain latch 802 securely, thereby joining left lateral vertical member 104, cross member 102 and right lateral vertical member 106 in a compact side-by-side configuration for storage and travel. Handle 704 provides a convenient means for the user to carry the present invention.

As should be appreciated, braces 120 and the connection of vertical members 104 and 106 to the ends of the cross member 102 cooperate to provide a very stable sawhorse, and permit lightweight material such as plastic, which is the preferred material, to at least be used for the cross member and vertical members, but also if desired for all elements of the sawhorse.

A preferred embodiment of the present invention has been described, it will be appreciated by those of ordinary skill in the art that variations may be made thereto without departing from the spirit of the invention or the scope of the appended claims.

What is claimed is:

1. A lightweight sawhorse which can be compactly disassembled and stored:

a rigid cross member (102) extending horizontally in the assembled sawhorse, said cross member having a front and a back face;

left (104) and right (106) vertical members supporting left and right ends of said cross member, said vertical members each having a bracket (112,114) which extends between a front leg (108) and a back leg (110) and transversely to said cross member; and left (120) and right (122) brace members each with a first and second end, each said brace member being attached at said first end to said corresponding left or right bracket and at said second end to said cross member;

retaining means (124), connected to said brackets (112,114), for retaining said brace members to said vertical members; and attachment means (500), disposed on said first end of said brace members for attachment to said vertical members, said attachment means being adapted to engage said retaining means and to allow said brace member to slide relative to said vertical member.

2. The sawhorse of claim 1, wherein each of said vertical members further comprises:

a threaded guide shaft fixed to said back leg and extending through said front leg; and a threaded nut with handle disposed near the front of said shaft;

said front leg member is relieved substantially parallel to said front face of said cross member in assembled position, and said back leg member is relieved substantially parallel to said back face of said cross member in assembled position thereby creating jaws of a vise to accept said cross member;

whereby turning said handle advances said nut and said front relief relative to said back relief thereby increasing compressive force on said cross member positioned therebetween.

3. The sawhorse of claim 2, wherein the largest lateral dimension at the base of at least one of said left (104) and right (106) vertical members is approximately the same as the lateral dimension near the top of said left and right vertical members.

4. The sawhorse of claim 3, further comprising:

fastening means (126) for rigidly connecting said left (120) and right (122) brace members to said cross member;

said left and right brace members being adapted at one end to engage said fastening means at an angle substantially parallel to said cross member in assembled position.

5. A lightweight collapsible sawhorse comprising:

a cross member having a top, bottom and opposed vertical sides;

opposed vertical support members adapted to be positioned at opposite ends of said cross member, said vertical support members including clamping jaws for clamping against the vertical sides of said cross member to support said vertical members with respect to said cross member;

brace members having a free end and an opposed end, said opposed end being pivotally mounted to said support members a spaced distance from said clamping jaws, said brace members being adapted to pivot between a storage position and an assembled position, said assembled position corresponding to said free end being removably attached to the bottom of said cross member to brace the vertical members with respect to said cross member;

storage connectors for connecting said vertical members and said cross member into a compact unit, said storage connectors including cooperating fasteners mounted upon at least two of said vertical members and cross member.

6. The sawhorse of claim 5, wherein said storage connectors include a latch on one of said vertical members and pins located on said other vertical member and said cross member, said pinon said cross member being approximately centered between the ends of said cross member, said cross member being adapted to be sandwiched between said vertical members and said latch being adapted to capture both pins to form a compact transportable unit.

7. The sawhorse of claim 6, wherein said storage connectors include a carrying handle.

8. The sawhorse of claim 5, wherein said vertical members and said cross member are made of lightweight material.

9. The sawhorse of claim 8, wherein said vertical members and said cross member are made of plastic.

10. The sawhorse of claim 8, wherein said at least said vertical members and said cross member are made of plastic.

11. The sawhorse of claim 5, wherein said brace member has a slot therein that permits said brace member to be moved from a storage position to an assembled position with respect to said vertical members.

12. The sawhorse of claim 5, said cross member includes a fastener mounted to the bottom thereof that includes a carrying handle for carrying the sawhorse when said sawhorse is in its stored position.

13. The sawhorse of claim 5, wherein said clamping jaws include screw threads and a crank handle.

14. The sawhorse of claim 5, wherein at least one of said vertical members has a base with a width greater than its top width and the other vertical member has a base with a width approximately equal to its top width.

15. A method for disassembling and compactly folding a sawhorse in which right and left vertical members grip a transverse cross member and left and right brace members movably attach between said vertical members and said cross member, comprising the steps of:

A. detaching said left and right brace members from said cross member;

B. detaching said cross member from said left and right vertical members;

C. positioning said left and right brace members substantially parallel to and flat against said left and right vertical members respectively;

D. positioning said cross member between said left and right vertical members to align a cooperating fastening means; and E. securing said left vertical member to said right vertical member utilizing said cooperating fastening means.

* * * * *

UNITED STATES PATENT AND TRADEMARK OFFICE

CERTIFICATE OF CORRECTION

PATENT NO. : 5,257,829
DATED : November 2, 1993
INVENTOR(S) : Fred Weeks

It is certified that error appears in the above-indentified patent and that said Letters Patent is hereby corrected as shown below:

Column 8, claim 6, line 4, delete "pinon" and insert --pin on--;
Column 8, claim 12, line 24 after "5," insert --wherein--.

Signed and Sealed this

Seventh Day of June, 1994

Bruce Lehman

*Attest:*

BRUCE LEHMAN

*Attesting Officer*

*Commissioner of Patents and Trademarks*